United States Patent [19]

Raasch et al.

[11] Patent Number: 4,641,494

[45] Date of Patent: Feb. 10, 1987

[54] DEVICE FOR FEEDING-IN A THREAD END INTO A SPINNING NIP OF A FRICTION SPINNING MACHINE

[75] Inventors: Hans Raasch; Heinz-Georg Wassenhoven, both of Mönchengladbach, Fed. Rep. of Germany

[73] Assignee: W. Schlafhorst & Co., Mönchengladbach, Fed. Rep. of Germany

[21] Appl. No.: 805,327

[22] Filed: Dec. 4, 1985

[30] Foreign Application Priority Data

Dec. 6, 1984 [DE] Fed. Rep. of Germany ..... 3444427

[51] Int. Cl.[4] ..... D01H 15/02; D01H 1/135

[52] U.S. Cl. ..... 57/401; 57/279; 57/352

[58] Field of Search ..... 57/261, 263, 279, 400, 57/401, 352

[56] References Cited

U.S. PATENT DOCUMENTS

| | | | |
|---|---|---|---|
| 3,601,969 | 8/1971 | Susami et al. | 57/263 X |
| 3,962,855 | 6/1976 | Stahlecker | 57/263 |
| 3,999,362 | 12/1976 | Schulz et al. | 57/263 |
| 4,539,804 | 9/1985 | Derichs | 57/263 |
| 4,541,233 | 9/1985 | Raasch et al. | 57/263 |
| 4,541,235 | 9/1985 | Raasch | 57/263 |

*Primary Examiner*—Donald Watkins

*Attorney, Agent, or Firm*—Herbert L. Lerner; Laurence A. Greenberg

[57] ABSTRACT

A device for feeding-in a thread end through a thread draw-off channel of a thread guiding element into a spinning nip of a friction spinning device includes a pressurized-gas injection device in the thread guiding element for producing an air flow in the thread draw-off channel opposite in direction to that of a thread draw-off direction of a spinning operation in the friction spinning device, whereby a thread end is entrained thereby, the thread draw-off channel continuing along the spinning nip from a termination thereof in the thread guiding element.

5 Claims, 4 Drawing Figures

DEVICE FOR FEEDING-IN A THREAD END INTO A SPINNING NIP OF A FRICTION SPINNING MACHINE

The invention relates to a device for feeding-in a thread end through a thread draw-off channel of a thread guiding element into a spinning nip of a friction spinning machine.

Heretofore, the thread end was brought into the spinning nip of a friction spinning device for the purpose of piecing or joining the thread by setting the suction device of the friction elements into operation for the purpose of producing an air flow or current through the thread draw-off channel and into the spinning nip which would be of such strength as to entrain the thread end and transport it into the spinning nip.

A disadvantage of such a procedure is that an unsightly, non-uniform and, under certain conditions, also non-durable thread joining or piecing location is formed.

It is accordingly an object of the invention to provide a device for feeding-in a thread end into a spinning nip of a friction spinning machine wherein an unobtrusive, uniform and durable thread piecing or joining location is produced during a piecing or joining operation.

With the foregoing and other objects in view, there is provided, in accordance with the invention, a device for feeding-in a thread end through a thread draw-off channel of a thread guiding element into a spinning nip of a friction spinning device, comprising a pressurized-gas injection device in the thread guiding element for producing an air flow in the thread draw-off channel opposite in direction to that of a thread draw-off direction of a spinning operation in the friction spinning device, whereby a thread end is entrained thereby, the thread draw-off channel continuing along the spinning nip from a termination thereof in the thread guiding element.

The invention results in the thread end being laid in an extended or outstretched position, and not somewhat coiled or tangled, into the spinning nip wherein, then, the spinning operation is started by feeding in new fibers and a good-looking, durable and uniform piecing or joining location is produced which need not be removed again afterwards and replaced by a knot or some other connection.

In accordance with another feature of the invention, the pressurized-gas injection device has at least one pressurized-gas channel disposed at an inclination to the thread draw-off direction and terminating in the thread draw-off channel.

In order to prevent the thread end from losing its twist during the piecing or joining operation or even beforehand, in accordance with a further feature of the invention, the pressurized-gas channel is disposed tangentially to the thread draw-off channel at a location at which it terminates therein. An air flow is thereby formed which extends not only in a direction simply opposite to the thread draw-off direction, but also has a slight twist, in the central axis of which the thread end is disposed.

The twisted flow travels around the thread end and, if the direction of the twisted flow coincides with the direction of the thread twist, the thread end cannot readily, if at all, lose its twist.

In accordance with an added feature of the invention, the pressurized-gas injection device has a coupling element matching another deliverable coupling element which is controllingly connectible to a pressure-gas source.

In such a construction, for example, the opening of a housing surrounding the friction unit is not prevented by any pressurized-gas lines or the like. The deliverable coupling element is delivered only during the piecing or joining operation and can then be withdrawn again. In accordance with a concomitant feature of the invention, the deliverable coupling element is connected to a travelling thread joining device.

A travelling piecing or joining device performs the joining or piecing operation in sequence at the individual friction spinning devices. Only one deliverable coupling element is therefore required for a plurality of friction spinning devices, and likewise only one control element for the coupling element and only one pressurized-gas source. The pressurized-gas source can, for example, also be carried along with the travelling piecing or joining device.

Other features which are considered as characteristic for the invention are set forth in the appended claims.

Although the invention is illustrated and described herein as embodied in a device for feeding-in a thread end into a spinning nip of a friction spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
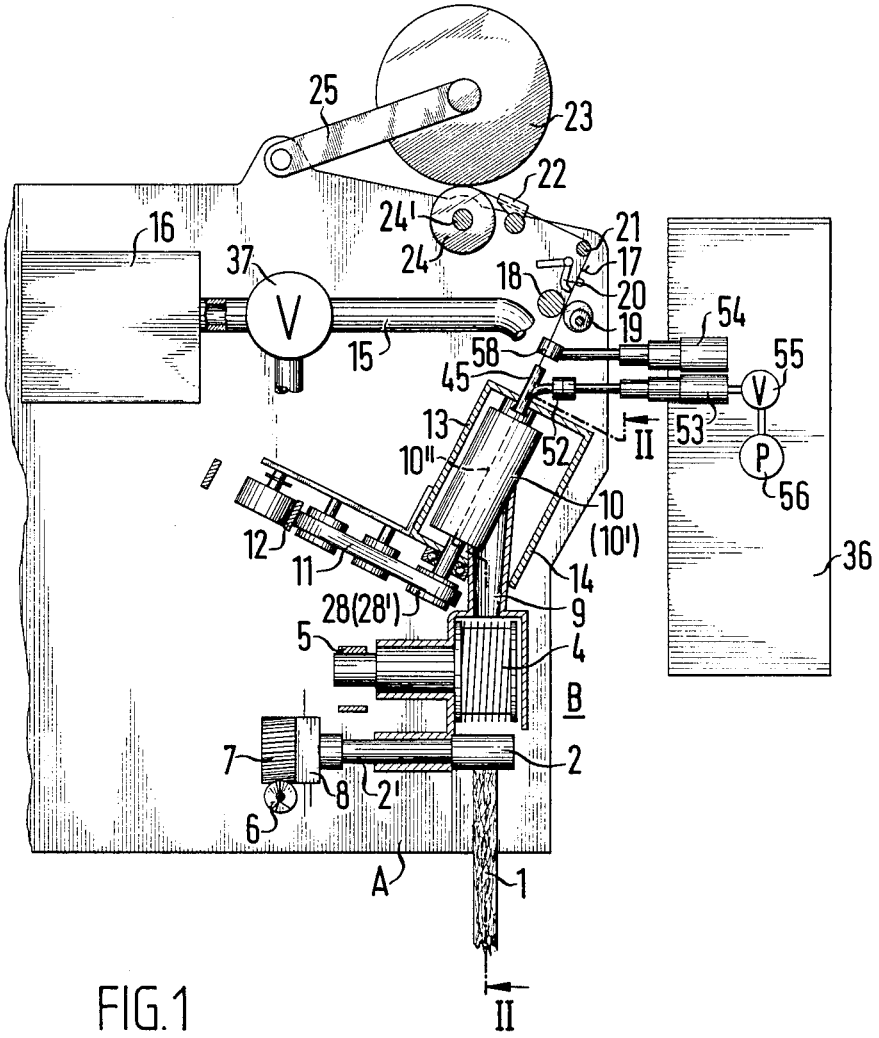
FIG. 1 is a diagrammatic vertical sectional view of a friction spinning device.

Referring now to the drawing and, first, particularly to FIG. 1 thereof, there is shown a friction spinning machine which is a combination of a number of individual friction spinning devices. The individual parts of the friction spinning devices are held together mainly by a machine frame A. A sliver 1 is fed via a drawing-in roller 2 and a clamping table 3 visible in FIG. 2 to a fiber-loosening roller 4 provided with needles or a sawtooth fitting. The loosening roller 4 rotates at a very high peripheral speed and loosens up the sliver 1 into individual fibers.

The drawing-in roller 2 is driven by a worm shaft 6 extending along the friction spinning machine. A worm gear 7 meshing with the worm shaft 6 is connected via an electromagnetic clutch 8 with a shaft 2' of the drawing-in roller 2.

The loosened fibers are fed via a fiber channel 9 into a spinning nip or wedge 10' formed by two screen drums 10, 10'. The parts 2 to 9 together form a fiber feeding device identified as a whole by reference character B.

The screen drums 10, 10' are driven in the same rotary direction by a belt 11 which, in turn, is driven by a tangential belt 12 running along the entire friction spinning machine. The screen drums 10, 10' are located in a housing 13 which is closed at the front thereof by a hinged cover 14.

Figure 2:
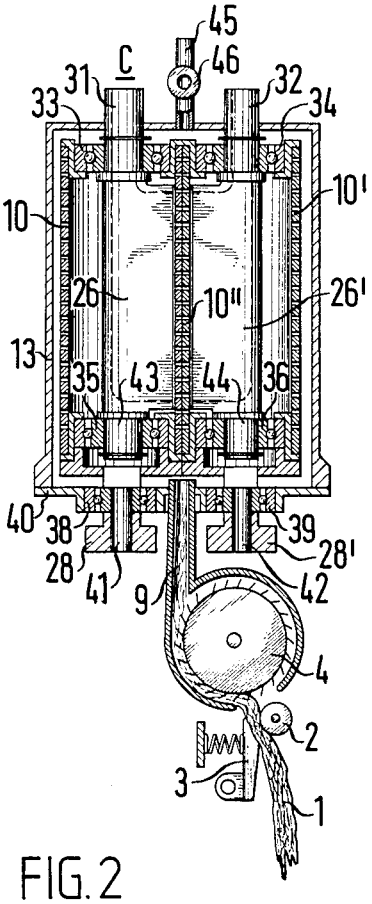
FIG. 2 is a fragmentary cross-sectional view of FIG. 1 taken along the line II—II in direction of the arrows.

It is especially apparent from FIG. 2 that the friction spinning device has a suction device C, which is bifurcated and terminates at two suction nozzles 26 and 26', of which the suction nozzle 26 is located in the interior of the screen drum 10, and the suction nozzle 26' in the interior of the screen drum 10'. Both suction nozzles 26 and 26' are almost equal in length to the length of the spinning nip or wedge 10'' (FIG. 1). The suction nozzles 26 and 26' terminate in the interior of the respective screen drum 10 and 10' so close to the respective wall thereof that they act to suck in air through the respective wall of the screen drum into the spinning wedge or nip 10'' the instant negative pressure from a channel 16 via a controllable valve 37 and a line 15 is delivered to the suction nozzles 26 and 26'. The thread 17 formed in the spinning nip 10'' is drawn off at constant speed by a draw-off shaft 18 extending lengthwise through the entire friction-spinning machine and a draw-off roller 19 resiliently biased against the draw-off shaft 18.

The thread 17 travels past a thread regulator 20 which may assume several control functions. In the event of a thread break, the thread regulator 20, for example, acts upon the electromagnetic clutch 8 which serves as a device for stopping the thread feed and brings the drawing-in roller 2 to a stop. Furthermore, if a thread should break, the thread regulator 20 may act upon a non-illustrated device which raises a coil frame 25 of a take-up coil 23 so that the take-up coil 23 is removed from contact with a winding roller 24 therefor. The thread regulator 20 can also take over other signaling and controlling functions. For example, it may issue a signal for enabling a thread piecing or joining device 36, which is travelling past, to repair the thread break.

The thread 17 travels past the thread regulator 20 over a diagonal pull equalizing or adjustment wire 21, runs through a reciprocating thread guide 22, and is wound onto the take-up coils 23 forming a cross-wound coil or cheese. In this regard, the take-up coil 23 rolls on the rotating winding roller 24 which has a shaft 24' extending along the entire friction spinning machine.

FIG. 1 shows that the fiber channel 9 is directed towards the screen drums 10 and 10' in such manner that it feeds fibers almost axially into the spinning nip 10''.

The automatic piecing or joining device 36 is constructed as a device which is capable of travelling so as to service all of the friction spinning devices of the friction spinning machine in sequence.

FIG. 2 shows that the suction device C has two suction unions or connecting pieces 31 and 32 which are connected to the line 15. The suction unions 31 and 32 are firmly connected to the housing 13 and carry roller bearings 33 and 34, respectively. The housing 13 is closed by an end cover 40 into which roller bearings 38 and 39 are inserted. The roller bearings 38 and 39 carry shafts 41 and 42, respectively, of two belt pulleys 28 and 28', respectively. Both shafts 41 and 42 concurrently carry the respective screen drums 10 and 10'. Roller bearings 35 and 36 are arranged in the interior of the screen drums 10 and 10' which are braced in the interior against stub shafts 43 and 44, respectively, which are connected, in turn, with the respective suction nozzles 26 and 26'.

In this manner, the screen drums 10 and 10' are rotatably mounted in the housing 13.

A thread guiding element in the form of a thread draw-off tubule 45 is located at the other end of the housing 13' and extends in axial direction of the spinning nip 10''. The thread 17 travels through this thread draw-off tubule during normal spinning operation.

Figure 3:
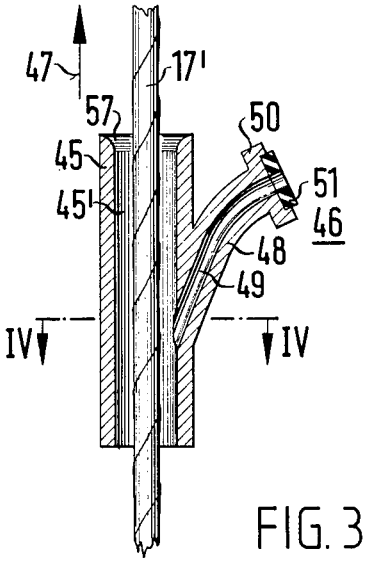
FIG. 3 is an enlarged, fragmentary, sectional view of FIG. 1 showing a thread draw-off tubule.
Figure 4:
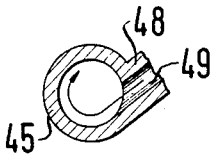
FIG. 4 is a cross-sectional view of FIG. 3 taken along the line IV—IV in direction of the arrows.

According to FIGS. 1, 3 and 4, the thread draw-off tubule 45 is of a quite special construction. It is formed of a pressurized-gas injection device identified as a whole by reference numeral 46. The pressurized-gas injection device 46 has a tube 48 which is formed with a pressurized-gas channel 49 in the interior thereof. The pressurized-gas channel 49 terminates in the thread draw-off channel 45' of the thread draw-off tubule 45 at an inclination to the draw-off direction represented by the arrow 47, and simultaneously tangentially to the thread draw-off channel 45'.

The pressurized gas-injection device 46 has a coupling element 50 in the shape of a flange with an inserted packing washer or sealing disc 51. The coupling element 50 is located at the outer end of the tube 48.

The coupling element 50 matches a further, deliverable or engageable coupling element 52 (FIG. 1), which is connected by a telescopic tube arrangement 53 with the travelling piecing or joining device 36. The deliverable or engageable coupling element 52 is formed likewise of a flange with an inserted packing washer which is located at one end of the tube arrangement 53. In engaged condition of the clutch, both of the packing washers or sealing discs are pressed tightly against one another. The telescopic tube arrangement 53 is connected via a control valve 55 to a pressurized gas source 56.

The travelling piecing or joining device 36 also has a second telescopic tube arrangement 54 which carries a deliverable or adjustable thread guide 58 located in front of the termination 57 of the thread drawing-off tubule 45. The deliverable thread guide 58 functions to bring a thread end, which is fetched or picked-up from the take-up coil 23 with the aid of the piecing or joining device 36 by otherwise non-illustrated means, to a location in front of the termination 57 of the thread draw-off tubule 45.

To eliminate a thread break or when the friction spinning device is set into operation for the first time, the piecing or joining device 36 comes travelling along, stops in front of the friction spinning device, initially performs cleaning operations, if necessary or desirable, and extends the telescopic tube arrangement 53 in order to deliver or engage the coupling element 52 with the coupling element 50 of the thread draw-off tubule 55 matching therewith. Simultaneously, the piecing or joining device 36 seeks out the thread end on the take-up coil 23, surrenders it to the thread guide 58 and then extends the second telescopic tube arrangement 54 in order to deliver, for example, the thread end 17' of FIG. 3 to the termination 57 of the thread draw-off tubule 45. At the latest, the piecing or joining device 36 then opens a control valve 55 to blow injector air into the thread draw-off tubule 45 through the pressurized gas channel 49. Air is entrained in a direction opposite the thread draw-off direction represented by the arrow 47, and the air current, which is made up of the supplied pressurized gas and the entrained ambient air, flows through the thread draw-off tubule 45 and then, after leaving the thread draw-off tubule 45, flows in longitudinal direction through the nip 10''. The thread end 17' is thus entrained, and is inserted in stretched-out condition into the nip 10″. At the latest, then, the screen drums 10 and 10′ are set into operation, and the suction nozzles 26 and 26′ are subjected to suction air by opening the three-way valve 37. Also, the previously non-operating fiber feeding device B is set into operation again and, the instant the separated or isolated individual fibers reach the spinning nip or wedge 10″, the draw-off roller 19 is again brought into contact with the draw-off shaft 18 in order to draw the thread continuously out of the spinning nip 10″ and to feed it to the take-up coil 23, which is simultaneously brought into contact again with the winding roller 24.

All of these activities can be enabled and controlled, respectively, automatically by the piecing or joining device 36. A non-illustrated program-controlling device would be in position for that purpose.

After the piecing or joining operation has been completed, the piecing or joining device 36 then again retracts both of the telescopic tube arrangements 53 and 54. Thereafter, it is again ready to travel farther to a different operative location.

As mentioned hereinabove, the invention is not limited to the specifically described and illustrated embodiment. In particular uses, it may be advantageous, for example, to provide more than one pressurized gas or compressed air channel 49. If several of such pressurized gas channels are provided, they can be connected to one another by a ring channel or a ring line encircling the thread draw-off tubule 45.

We claim:

1. Device for feeding-in a thread end through a thread draw-off channel of a thread guiding element into a spinning nip of a friction spinning device, comprising a pressurized-gas injection device in the thread guiding element for producing an air flow in the thread draw-off channel opposite in direction to that of a thread draw-off direction of a spinning operation in the friction spinning device, whereby a thread end is entrained thereby, the thread draw-off channel continuing along the spinning nip from a termination thereof in the thread guiding element.

2. Device according to claim 1, wherein said pressurized-gas injection device has at least one pressurized-gas channel disposed at an inclination to the thread draw-off direction and terminating in the thread draw-off channel.

3. Device according to claim 2 wherein said pressurized-gas channel is disposed tangentially to the thread draw-off channel at a location at which it terminates therein.

4. Device according to claim 1 wherein said pressurized-gas injection device has a coupling element matching another deliverable coupling element which is controllingly connectible to a pressure-gas source.

5. Device according to claim 4 wherein said deliverable coupling element is connected to a travelling thread joining device.

* * * * *